US005549217A

United States Patent [19]

Benarrouch

[11] Patent Number: 5,549,217

[45] Date of Patent: Aug. 27, 1996

[54] DEVICE FOR WITHDRAWING SPHERICAL PRODUCTS OF THE SAME DIMENSIONS, SUCH AS GRANULES

[75] Inventor: Jacques Benarrouch, Villeurbanne, France

[73] Assignee: Boiron, France

[21] Appl. No.: 354,860

[22] Filed: Dec. 9, 1994

[30] Foreign Application Priority Data

Dec. 14, 1993 [FR] France ..... 93 15325

[51] Int. Cl.[6] ..... A47F 1/04

[52] U.S. Cl. ..... 221/155; 221/187; 221/257; 221/265; 221/277; 221/225; 221/237

[58] Field of Search ..... 221/155, 186, 221/187, 195, 196, 255, 256, 257, 263, 264, 265, 266, 277, 224, 225, 236, 237

[56] References Cited

U.S. PATENT DOCUMENTS

| | | | |
|---|---|---|---|
| 2,851,191 | 9/1958 | Semsch | 221/264 |
| 3,241,712 | 3/1966 | Sacchetti et al. | 221/265 |
| 3,874,564 | 4/1975 | Huneke | 221/266 X |
| 3,991,908 | 11/1976 | Thomas et al. | 221/265 X |
| 4,460,106 | 7/1984 | Moulding, Jr. et al. | 221/265 X |
| 4,611,727 | 9/1986 | Graff | 221/265 X |
| 4,613,057 | 9/1986 | Sacchetti et al. | 221/265 |
| 4,844,295 | 7/1989 | Deardorff | 221/263 |
| 5,123,574 | 6/1992 | Poulos | 221/264 X |

FOREIGN PATENT DOCUMENTS

| | | | |
|---|---|---|---|
| 0002403 | 6/1979 | European Pat. Off. . | |
| 1540938 | 10/1968 | France . | |
| 2492777 | 4/1982 | France . | |
| 2625982 | 7/1989 | France . | |
| 2660288 | 10/1991 | France | 221/265 X |

*Primary Examiner*—William E. Terrell
*Assistant Examiner*—Dean A. Reichard
*Attorney, Agent, or Firm*—Parkhurst, Wendel & Burr

[57] ABSTRACT

A dispenser for dispensing granules from a container having a circular mouth, includes a body having first and second cylindrical components joined together by an axial spindle, a cylindrical roundel including a radial slit which is adapted to clip onto the axial spindle, and a receptacle. The first and second cylindrical components of the body have a plurality of circumferential notches adapted to receive granules from the container. The cylindrical roundel has a radial slit which receives a single granule from the first cylindrical component, for passage to the second cylindrical component. The receptacle includes driving means adapted to rotate the body for dispensing the granules.

9 Claims, 5 Drawing Sheets

DEVICE FOR WITHDRAWING SPHERICAL PRODUCTS OF THE SAME DIMENSIONS, SUCH AS GRANULES

TECHNICAL FIELD

The invention relates to a device designed for withdrawing spherical components of identical size contained in a container with a cylindrical neck and circular mouth, and the main application of which is the dispensing and counting of small granules for medical use and more precisely homoeopathic granules.

PRIOR ART

In document FR-A-2,492,777 there is proposed a granule-dispensing device including a stopper exhibiting a recess which acts as an intermediate chamber, this stopper having passing through it a spindle joining two movable disks each equipped with a slot. As the outer disk rotates, the inside of the tube is closed in communication with the intermediate chamber via the slot placed on the inner disk. The granules accumulate in the intermediate chamber then, during additional rotation, this intermediate chamber and the outside space of the tube are placed in communication, which allows the number of granules which can be stored in the intermediate chamber to be dispensed.

Such a device does not allow granules to be supplied one at a time. Furthermore, all of the dispenser body is inside the tube, which decreases the volume left for the granules.

In document FR-A-2,625,982 there is described a granule dispenser composed of a base plate fixed to the neck of the tube and through which there passes at least one opening and the central part of which has passing through it a freely turning spindle joining two components situated on each side of the stopper. The component placed inside the tube is composed of several radial arms between each of which there is defined a housing capable of receiving one granule. The second component placed on the outside of the stopper is a disk pierced with a slot intended to come to face the opening in the stopper which is acting as an intermediate chamber. Just like the first embodiment, the dispenser body is, to a large extent, pushed inside the tube, which reduces the volume left available for the granules. Furthermore, the components proposed to produce this dispenser assembly are of a complicated shape, and are therefore difficult to produce by molding. Finally, and above all, the assembly proposed does not have any symmetry, which increases the difficulties in automating the fitting of this device at the end of the tube.

SUMMARY OF THE INVENTION

The invention alleviates these drawbacks, that is to say that it provides a device of simple shape, easy to mold and exhibiting symmetry which makes it easy to automate the fitting thereof.

The invention relates to a device for withdrawing spherical products of the same dimensions, such as small pills or granules, contained in a container exhibiting a cylindrical neck and a circular mouth, of the type comprising:

a body for dispensing products, this body consisting of two parallel cylindrical parts respectively a first part and a second part, joined at their center by a spindle, each cylindrical part exhibiting notches intended to receive a product, said notches being offset from one part to the other so that a solid section of one part corresponds to a notch in the other part;

a cylindrical roundel exhibiting a radial slit connected to an axial passage intended to interact with the spindle, and at least one axial recess to allow the products to pass from the first to the second part, said roundel having a diameter slightly greater than the internal diameter of the neck of the container to allow tight fitting at the circular end of the container;

a receptacle stopper fitting onto the circular mouth of the container and exhibiting means for driving the dispensing body in terms of rotation, wherein:

the first part and second part are identical;

and the first part, the second part and the roundel have a thickness slightly greater than the diameter of a product.

In other words, the invention consists in fitting at the end of the tube a roundel exhibiting an opening able to allow one granule to pass and a central hole able to receive a spindle. This spindle joins two identical components in the overall shape of a disk including notches, the two disks being angularly offset so that the opening of the roundel can only be found on one side at a time. Thus, the dispensing body exhibits symmetry allowing it to be fitted to the roundel equally well in both directions.

Advantageously, in practice, the radial slit in the roundel is composed of an axial drilling proper, designed to clip over the spindle of the dispensing body, and the axial slit proper is flared into the shape of a sector of a cylinder in order to form the recess intended to receive a product.

In one embodiment, the cylindrical roundel bears, inside the neck, on rests formed for this purpose on the internal face of the neck.

In another embodiment, the cylindrical roundel on one of the two edges, exhibits a collar for bearing on the circular mouth of the container.

Advantageously, to ensure that the granules flow out properly, the solid angles of intersection of the notches of the dispensing body and of the roundel are chamfered. Preferably, the inclination of the chamfer of the external faces of each of the two parts of the dispenser body is greater than that of the internal chamfer. This geometry makes flow reversible, that is to say from the tube towards the receptacle, or from the receptacle towards the tube in the event of too many granules having been delivered.

As regards the driving device, in one alternative, this consists of:

a central pivot located inside the receptacle stopper on the axis of symmetry of the stopper, said pivot exhibiting a driving shape at its end;

and a complementary shape located at the center of the external face of each of the two parts of the dispensing body.

In another embodiment of the driving means, the solid sectors of the two parts of the dispensing body are provided with at least one driving tooth situated on their external face ending in the receptacle, the receptacle being provided on its internal partition with an annulus gear situated in a plane parallel to the faces of the dispenser in order to rotate the latter through meshing with the teeth of its external face.

In a preferred embodiment, the notches of the dispensing body consist of three evenly spaced radial sectors. This allows two or three granules to be dispensed per turn of the dispensing body.

To facilitate the counting-out and viewing of the granules dispensed, the receptacle stopper is preferably made of a transparent plastic substance, while the container containing the granules is a cylindrical tube made of a colored plastic substance in order to protect said granules from the light.

BRIEF DESCRIPTION OF THE DRAWINGS

The way in which the invention may be achieved, and the advantages which stem therefrom will become clearer from the embodiment which follows, supported by the appended figures.

EMBODIMENT OF THE INVENTION

Figure 3:
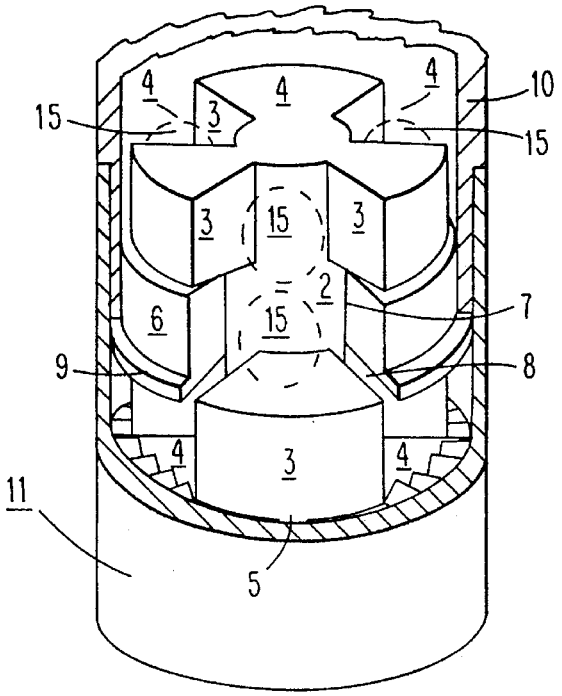
FIG. 3 is a view in perspective which represents the dispensing body and the roundel, assembled.
Figure 7:
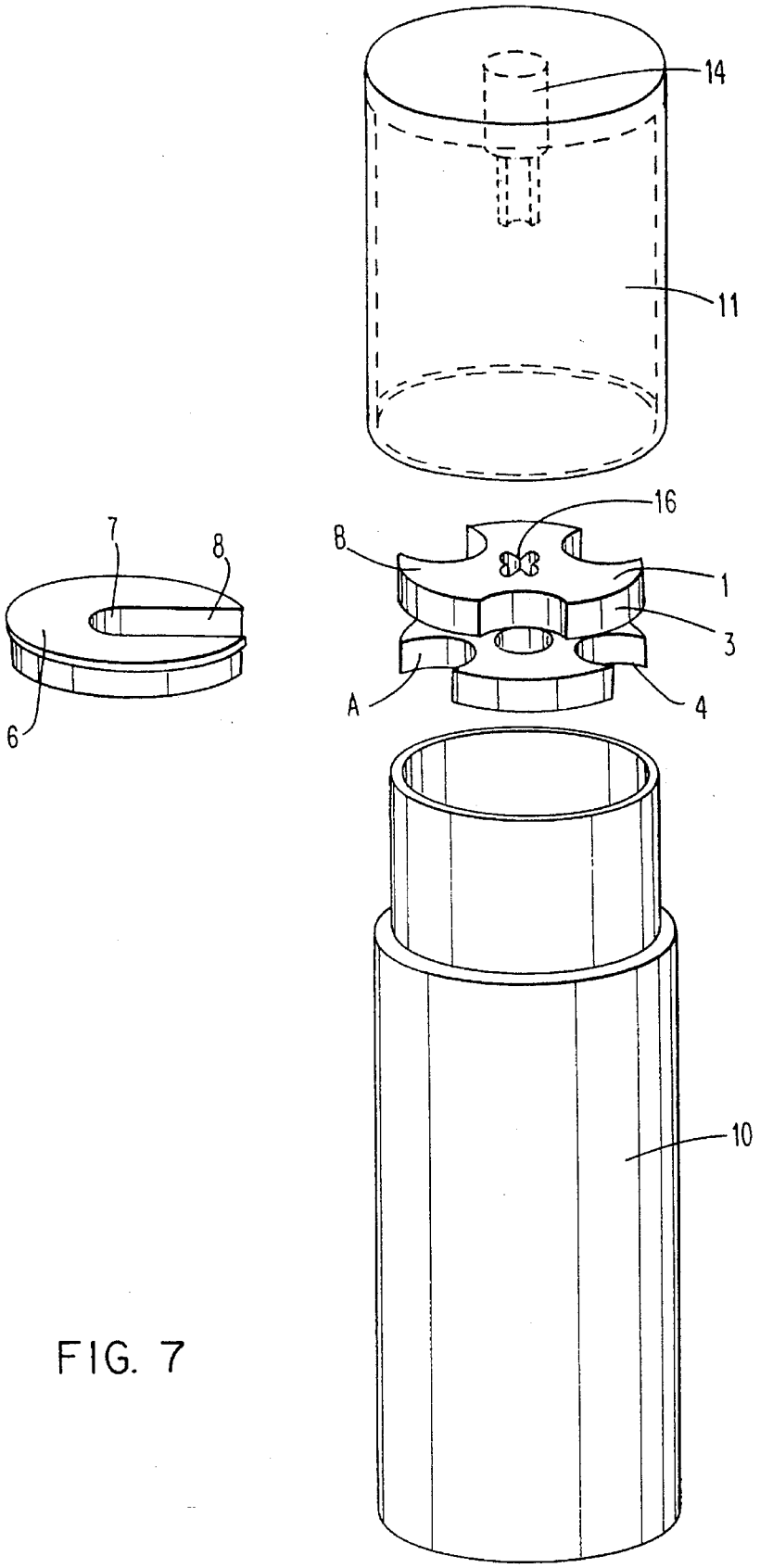
FIG. 7 is an exploded overall perspective view of the whole of the withdrawing device.
Figure 8:
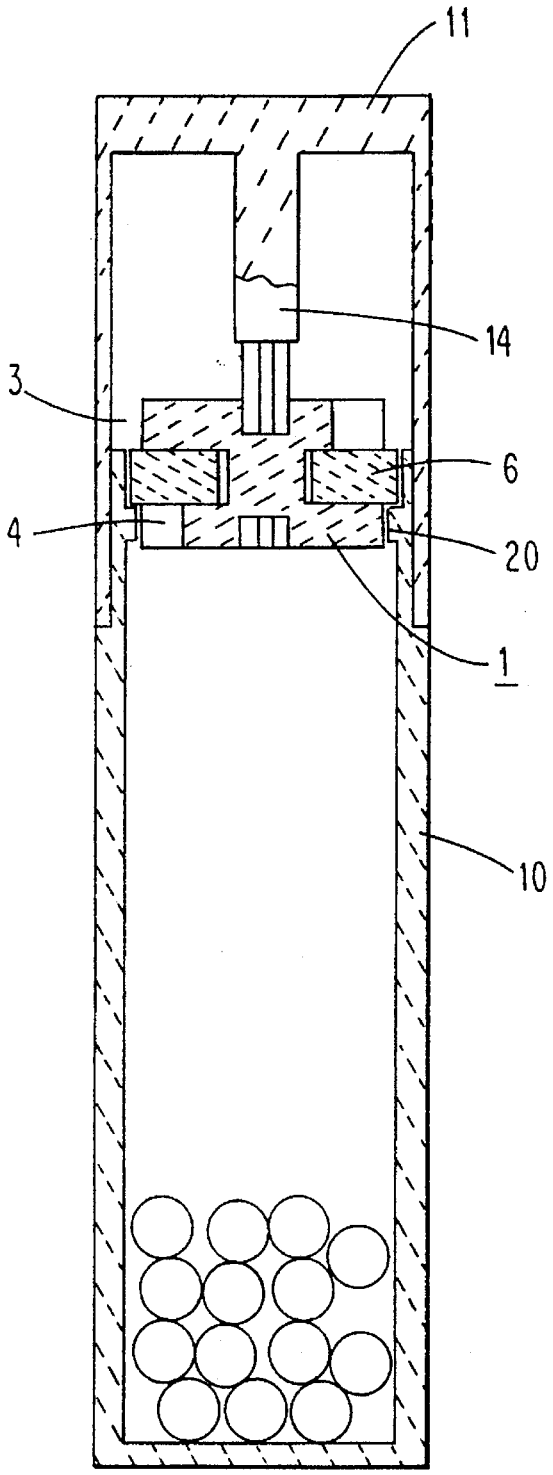
FIG. 8 is a section through a tube including the withdrawing device.

As represented in FIGS. 3 and 7, the granule dispensing device is essentially composed of three parts, namely a roundel (6) placed at the mouth of the tube, a pivoting dispensing body at the center of the stopper, and a receive receptacle (11) able to the granules.

Figure 1:
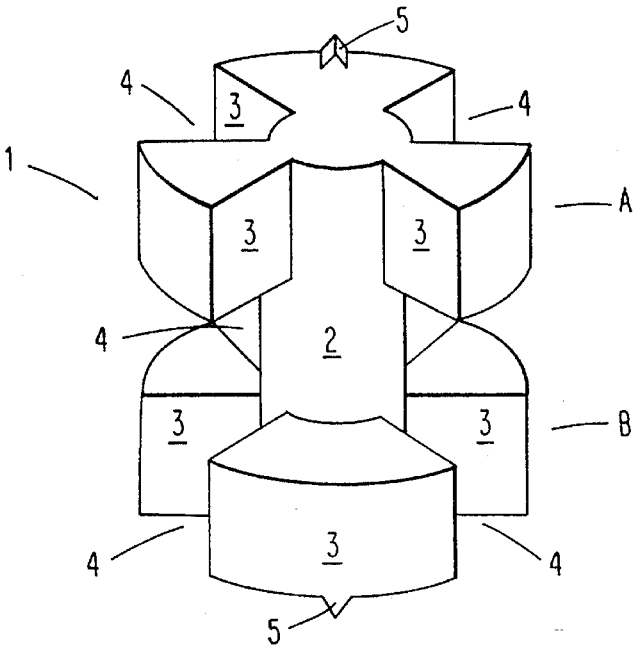
FIG. 1 is a view in perspective which represents the dispensing body according to the invention.
Figure 2:
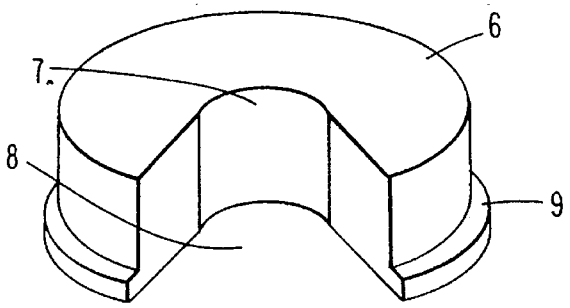
FIG. 2 is a view in perspective which represents the open roundel according to the invention.
Figure 5:
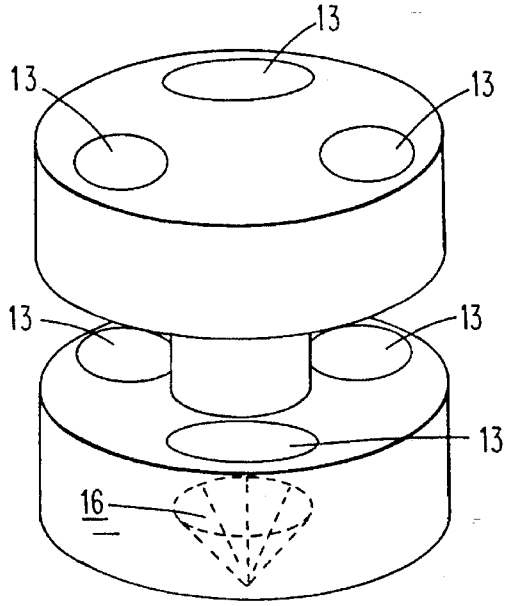
FIG. 5 is a view in perspective of the dispensing body according to another alternative embodiment.

The granule dispensing body (1), as represented in FIG. 1, consists of two cylindrical parts A and B which are symmetrical relative to a spindle (2) connecting them by the center. These two parts A and B are identical and each consists of sectors of cylinders (3), these sectors being concentric, equal to one another, and cut vertically from the thickness of said part, and separated from one another by openings (4) which are equal to one another and concentric with the sectors of cylinders (3) whose dimensions are matched to the diameter of the granules to be withdrawn. The two parts A and B which are symmetrical and face one another relative to the spindle (2) are offset so that a solid sector of cylinder (3) of the part A corresponds to an empty sector of cylinder (4) of the part B. As represented in FIG. 1, the solid sectors (3) and the empty sectors (4), which are equal to one another, in a preferred version are three in number, thus allowing one granule to be dispensed for every third of a turn of the dispensing body (1). This way of dispensing is particularly well suited to counting out conventional prescriptions which generally correspond to three, or perhaps five granules.

The two parts A and B are of identical size, which makes it equally possible, for rapid, manual or automatic assembly, to form one or other face of the dispensing body, which avoids any waste of time, and eliminates any possibility of error.

The cylindrical roundel (6) includes an external peripheral shoulder (9) which acts on the mouth of the granule container (10), as represented in FIG. 3. The thickness of this roundel (6) is slightly greater than the diameter of a granule to be withdrawn. This roundel (6) has passing through it an axial drilling (7) and an axial recess (8). The axial drilling (7) situated at the center of said roundel (6) has the right diameter to grip the spindle (2) of the dispenser body (1) with a slight force. The recess (8) is slightly secant to the axial drilling (7) and also exhibits an opening toward the outside of the roundel, so as to make it possible for the roundel (6), by virtue of the opening consisting of the drilling (7) and the recess (8) on the one hand to position itself on the spindle (2) of the dispenser body (1) and, on the other hand, to allow a granule to pass between the symmetric parts A and B of the dispensing body (1) when these two parts A, B and the roundel (6) are joined together and positioned horizontally under the vertical tube (10) relating to the granules to be withdrawn.

The granule receptacle (11), made of a transparent substance, has the main function of receiving the granules as they leave the tube, and of allowing the dispensing body (1) to be driven.

Figure 4:
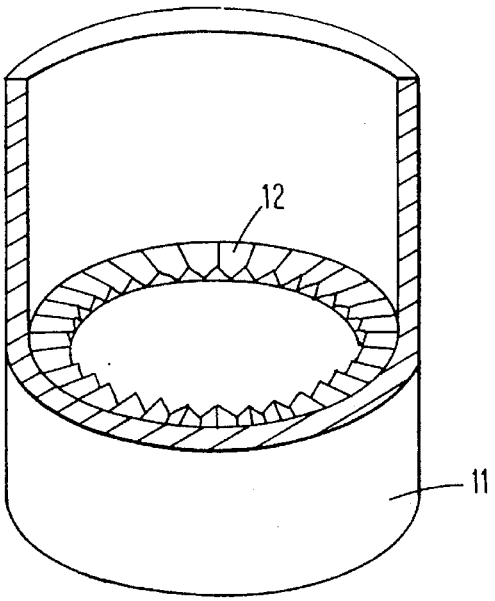
FIG. 4 is a view in perspective in longitudinal median partial section of the granule receptacle according to one alternative of the invention.

For this purpose, and in an alternative represented in FIG. 4, this receptacle includes an annulus gear (12), situated in a plane parallel to that of the mouth of the granule container, inside the receptacle secured to it, and the teeth of which point towards the granule container. Moreover, on each part A, B of the dispensing body, at least one of the solid sectors (3) includes a driving tooth (5) meshing with that of the annulus gear (12) of the granule receptacle. This annulus gear has a thickness appropriate to that of the driving teeth (5) of the dispensing body (1). The latter is inscribed inside a cylinder whose generating diameter corresponds approximately to the diameter of the circle which generates the internal cylinder of the receptacle, for rotations under optimism conditions. The teeth of the annulus are identical to those of the dispensing body (1) for perfect meshing in terms of rotation.

Figure 6:
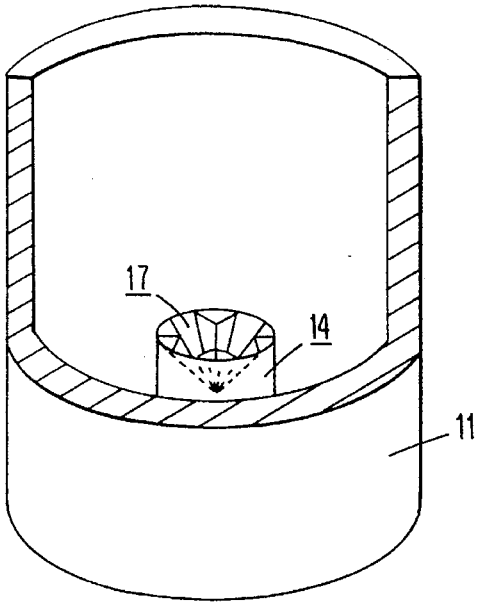
FIG. 6 is a view in perspective in longitudinal median partial section of the granule receptacle according to an alternative embodiment.

FIG. 6 shows another means of driving the dispensing body by rotating the receptacle, in which means the central core (14) located at the bottom and inside the receptacle (11) includes a female adapter (17) of polyhedral shape which interacts with a complementary driving system (16) situated at the center of the external part of the dispensing body in order to drive the latter in terms of rotation.

In the alternative represented in FIG. 7, the central core (14) receives a cross-shaped male adapter which interacts with a complementary shape (16) formed in the center of the external part of the dispensing body.

It goes without saying that the drive may be achieved by any type of adapter, male or female, internal or external, of the polyhedral cross-shaped type, or any other self-centering type.

For the purpose of making sure that there is sufficient volume to receive granules in the receptacle (11), it is appropriate for the dimension between the base of the annulus gear and the bottom of said receptacle to be at least equivalent or preferably slightly greater than the diameter of the granules to be withdrawn.

The use of a central core for driving the dispensing body makes it possible to maintain sealing between the inside of the tube and the outside when the receptacle is in the closed position. This sealing is not afforded in existing devices in which drive takes place through a splined ring situated at the periphery of the dispensing body and interacting with a splined ring placed inside the receptacle.

Figures 9, 10, 11, 12, 13, 14:
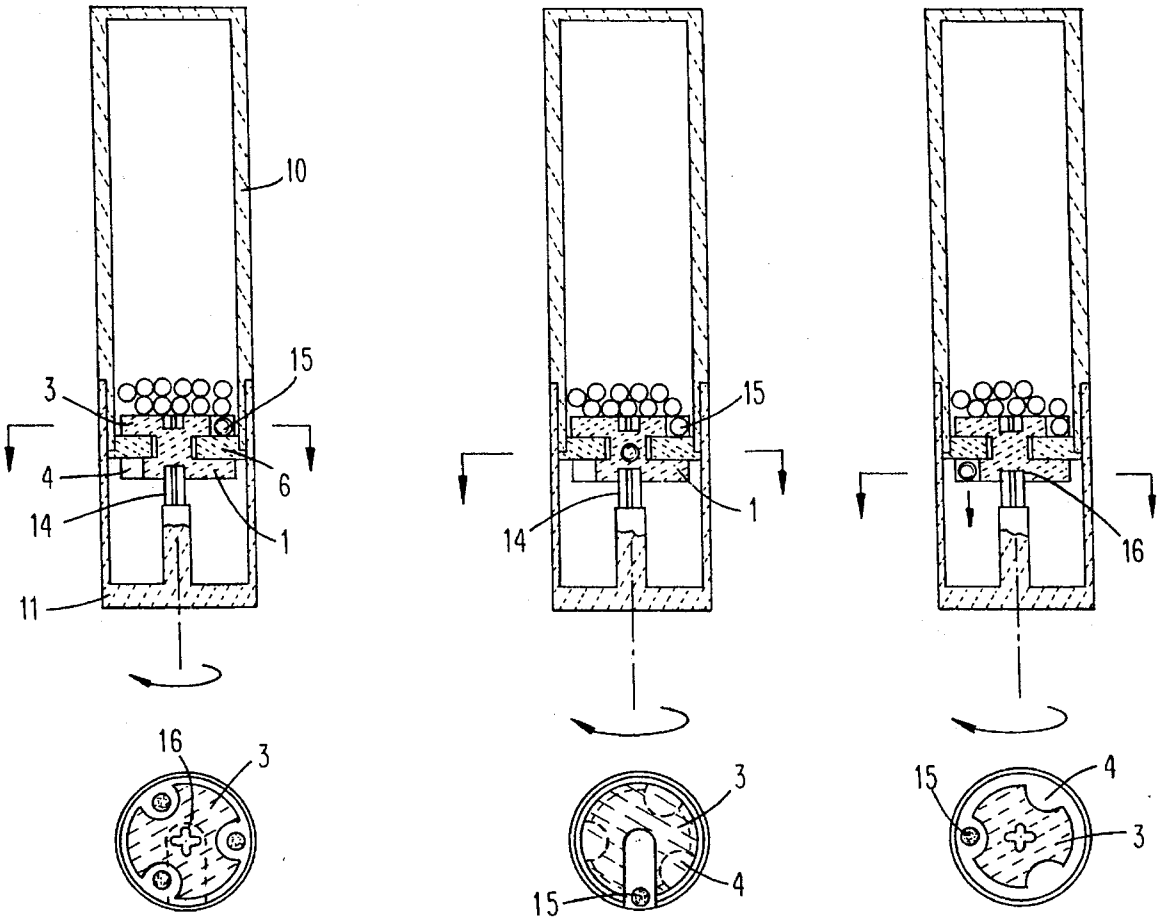
FIGS. 9, 10, 11 are sections of the tube equipped with the withdrawing device, making it possible to see, progressively, the movement of a granule inside the dispensing device.
FIGS. 12, 13, 14 are sections of FIGS. 9, 10, 11 taken respectively on the planes identified by the arrows in FIGS. 9,10,11.

The operation of this granule dispenser is illustrated in FIGS. 9 to 14. Firstly, the tube is inverted so that the receptacle is pointing downward. Through gravity, the granules (15) become positioned in all the sectors of cylinders (4) of the part A of the dispensing body (1), as represented in FIGS. 9 and 12. Next, as can be seen in FIGS. 10 and 13, as soon as one of the sectors of cylinders (4) of the part A of the dispensing body (1) is in register with the granules passage consisting of the recess (8) of the roundel (6), a first granule (15) drops under gravity into said passage and remains on standby on the upper face of a solid sector of the part B, while a second granule becomes superimposed on the first in the empty sector of cylinder (4) of the part A of the dispensing body (1).

After having turned the receptacle (11) through a third of a turn, the first granule (15) falls into said receptacle (11), while the second is driven over the roundel (6) by one of the two solid sectors of cylinders (3) of the part A of the dispensing body (1). This rotation brings one of the solid sectors of cylinders (3) of the part A back into a position where it closes the passage (8) in the roundel (6) and brings one of the empty sectors of cylinders (4) of the part B back into a position where it opens said passage (8), which allows the first granule to drop into the receptacle.

Using a dispensing body (1) with three solid sectors of cylinders on each part, it can be seen that for each complete rotation three granules are dispensed.

To further improve the symmetry of the system, the roundel (6) may be produced symmetrically. In this case, the roundel (6) is inserted into the neck of the tube until it bears on rests formed inside this tube.

The symmetry of the dispensing body advantageously makes it possible to have the granules running from the receptacle towards the inside of the tube, in the case where too many granules have been dispensed by accident.

It emerges clearly from the foregoing description that the withdrawal device according to the invention exhibits numerous particularly favorable advantages. On the one hand, in terms of operation, the system makes it possible to gain complete control over the number of granules dispensed, both in terms of dispensing and in terms of putting granules back in, as well as maintaining the sealing necessary for optimum keeping of the granules. On the other hand, as regards the manufacture and fitting of the device, the symmetry of the dispensing body allows great simplification of injection molds and also ease of automation of the fitting operation, which results in a drop in necessary investment, and an increase in the output and manufacturing rates.

I claim:

1. A dispenser for dispensing granules from a container having a circular mouth, comprising:

a body comprising first and second cylindrical components, said first and second cylindrical components being identical to each other and being joined together by an axial spindle, each of said first and second cylindrical components having a plurality of circumferential notches adapted to receive granules from the container, wherein said notches of the first component are axially offset from said notches of the second component;

a cylindrical roundel including a radial slit which opens into a central axial through-passage such that said cylindrical roundel is adapted to clip onto said axial spindle, said cylindrical roundel being adapted to tightly fit into the circular mouth of the container; and a receptacle adapted to fit onto the circular mouth of the container and comprising driving means to rotate said body.

2. The dispenser of claim 1, wherein said radial slit of said cylindrical roundel flairs outward to form a sector of a cylinder.

3. The dispenser of claim 1, wherein said cylindrical roundel is adapted to bear against rests formed in the mouth of the container.

4. The dispenser of claim 1, wherein said cylindrical roundel includes an outer collar portion which is received by the mouth of the container.

5. The dispenser of claim 1, wherein corner portions of the first and second components defining the notches and corner portions of the cylindrical roundel defining the radial slit, are chamfered.

6. The dispenser of claim 1, wherein said driving means comprises a central core for receiving and driving the axial spindle.

7. The dispenser of claim 1, wherein said first component further comprises a driving tooth protruding into the receptacle, and said receptacle further comprises an inner annular gear which engages the driving tooth, whereby rotation of the receptacle rotates said body.

8. The dispenser of claim 1, wherein each of said first and second cylindrical components comprises three equiangularly spaced notches.

9. The dispenser of claim 1, wherein said receptacle is comprised of a transparent plastic material.

* * * * *